United States Patent [19]

Miller et al.

[11] 4,454,857

[45] Jun. 19, 1984

[54] PEEP SIGHT FOR A BOW

[76] Inventors: Allen W. Miller, 32 Champayne Dr., Lake St. Louis, Mo. 63367; Cornelius F. Carroll, 1310 Tuxedo Ave., Parma, Ohio 44134; Lloyd E. Abernathy, 10922 Killdare Ct., St. Anns, Mo. 63074

[21] Appl. No.: 425,226

[22] Filed: Sep. 28, 1982

[51] Int. Cl.[3] ..... F41B 5/00

[52] U.S. Cl. ..... 124/87

[58] Field of Search ..... 124/87, 23 R, 24 R, 124/90, 92; 356/247; 33/265, 46

[56] References Cited

U.S. PATENT DOCUMENTS

| | | | |
|---|---|---|---|
| 3,199,502 | 9/1962 | Stonecipher | 33/46 |
| 3,410,644 | 11/1968 | McLendon | 33/265 X |
| 3,418,718 | 12/1968 | Current et al. | 33/46 |
| 3,703,770 | 11/1972 | Sofield | 33/265 |
| 3,703,771 | 11/1972 | Saunders | 124/90 X |
| 3,859,733 | 1/1975 | Chesnick | 33/265 |
| 3,942,507 | 3/1976 | Opal | 124/87 |
| 4,011,853 | 3/1977 | Fletcher | 124/87 |
| 4,116,194 | 9/1978 | Topel | 33/265 X |

*Primary Examiner*—Richard J. Apley
*Assistant Examiner*—William R. Browne
*Attorney, Agent, or Firm*—Charles E. Markham

[57] ABSTRACT

A bow string mounted peep sight has the form of a wheel with an elongated hollow hub tightly receiving the bow string and spokes connecting the hub to a rim. When the bow is in a braced condition with the bow string vertical the rim and spokes are horizontal and when the bow is drawn the sight is very close to the archer's eye and the rim is tilted revealing to the archer's eye sighting openings between the hub and rim irrespective of any rotation of the sight which may occur due to twisting of the bow string.

6 Claims, 10 Drawing Figures

PEEP SIGHT FOR A BOW

This invention relates to peep sights for archery bows and particularly to an improved bow string mounted peep sight, the operation of which is unaffected by rotation thereof due to twisting of the bow string.

BACKGROUND OF THE INVENTION

In prior bow string mounted peep sights it was essential to maintain the axis of the sighting aperture of bow string mounted peep sights on the sight line extending from the archer's eye to a front sight mounted on the bow handle against any rotation of the sight due to inadvertent twisting of the bow string during drawing of the bow. Any proposed additional devices required to preclude twisting of the bow string would prove cumbersome to most archers particularly when hunting game with a bow.

OBJECTS OF THE INVENTION

An object of this invention is to provide a generally new and improved bow string mounted peep sight for a bow convenient to adjust along the bow string and which is unaffected by rotation thereof due to twisting of the bow string.

A further object is to provide a peep sight for a bow which may be conveniently mounted on a bow string without unstringing the bow and without spreading the strands of a multistrand bow string.

A further object is to provide a particularly light weight, non-reflective peep sight for mounting on the bow string of a bow.

Further objects and advantages will appear when reading the following description in connection with the accompanying drawings.

THE DRAWINGS

DESCRIPTION OF A PREFERRED FORM OF THE INVENTION

Figures 1, 2, 3, 4, 5, 6, 7, 8, 9, 10:
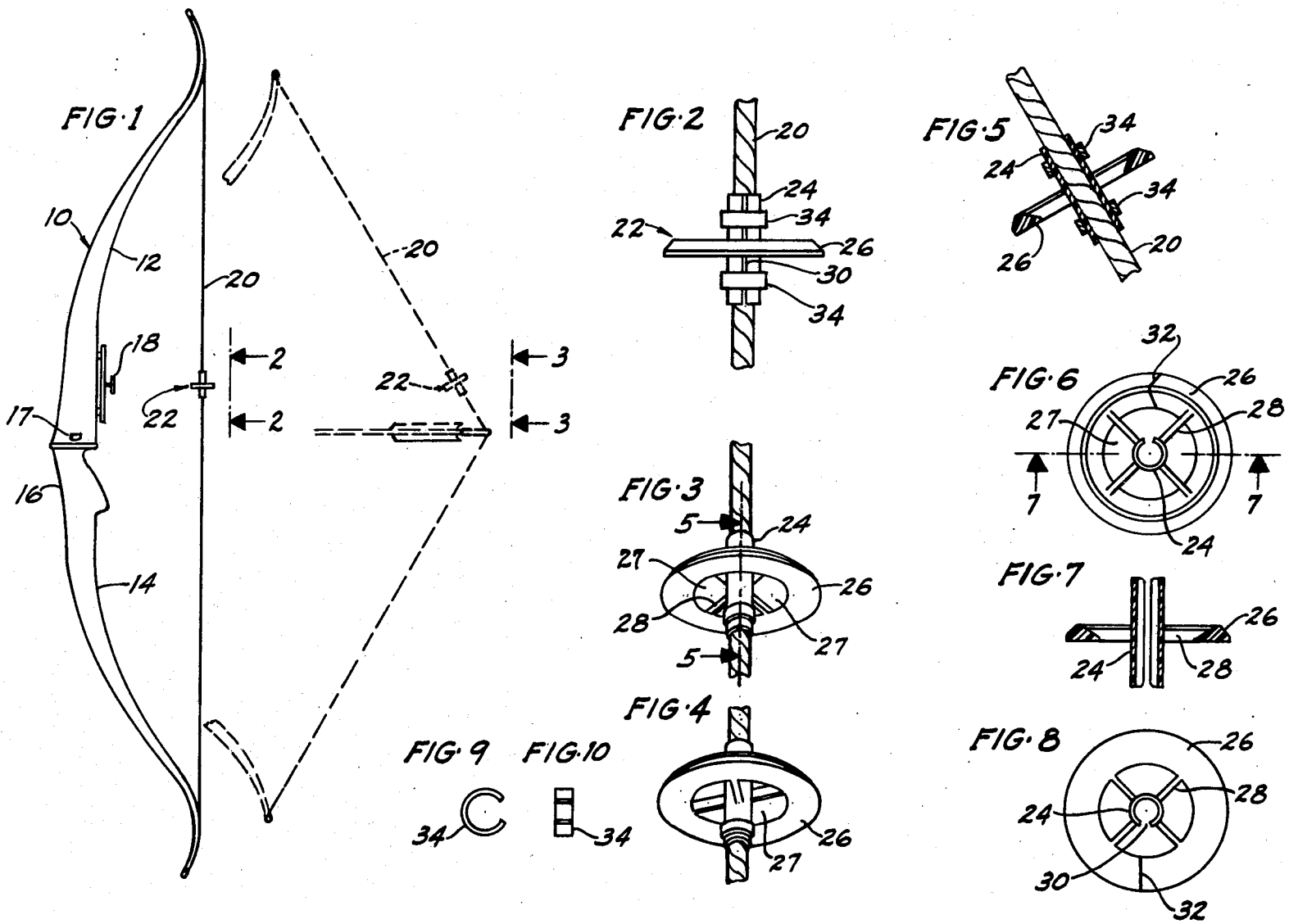
FIG. 1 is a side elevational view of a bow having a peep sight constructed in accordance with the present invention mounted on its bow string. The bow is shown in full lines in a braced condition and is shown fragmentarily in dotted lines in a drawn condition.
FIG. 2 is an enlarged rear elevational view of the peep sight mounted on a bow string and is taken along line 2—2 of FIG. 1.
FIG. 3 is an enlarged rear elevational view of the peep sight as it appears to the archer when the bow is drawn and is taken along line 3—3 of FIG. 1.
FIG. 4 is similar to FIG. 3 except that the peep sight is shown rotated approximately 90 degrees.
FIG. 5 is a cross-sectional view taken along line 5—5 of FIG. 3.
FIG. 6 is a top plan view of the peep sight shown alone.
FIG. 7 is a cross-sectional view taken along line 7—7 of FIG. 6.
FIG. 8 is a bottom plan view of the peep sight shown alone.
FIGS. 9 and 10 are plan and side elevational views respectively of the C-shaped, deformable attaching band.

Referring to the drawings in more detail, a bow generally indicated at 10 has upper and lower limbs 12 and

14, a handle section 16 with an arrow rest 17 mounted thereon, an adjustable front sight 18 attached to the handle section and a bow string 20 attached to the ends of the limbs. Bow 10 is shown in solid lines in a braced condition with a peep sight generally indicated at 22 attached to the bow string and positioned thereon above the arrow rest 17 so as to be on the upper half of the bow string and closely adjacent the archer's sighting eye when the bow is drawn as indicated in dotted lines.

The peep sight 22 has the form of a wheel with an elongated hollow cylindrical hub portion 24, a circular rim 26 concentric with the hub portion and four equally spaced spokes 28 connecting the hub 24 to the rim 26. When the bow is in a braced condition and held in a vertical attitude preparatory to drawing the bow, as shown in FIG. 1 in solid lines, the rim 26 of sight 22 is substantially horizontal. But when the bow is drawn, as indicated in dotted lines in FIG. 1, the rim 26 is tilted exposing sighting apertures 27 on both sides of the hub portion 24 to the archer's sighting eye as shown in either of the enlarged views of FIGS. 3 and 4.

Because the peep sight is positioned quite close to the archer's sighting eye when the bow is fully drawn and well within the point at which the eye is capable of focusing the connecting spokes 28 become sufficiently invisible to render inconsequential the variable positions the spokes may assume in the sighting apertures due to rotation of the peep sight as by the inadvertent twisting of the bow string. The archer may select a sighting aperture on one side or the other of the hub portion to suit conditions. The cross sectional dimensions of spokes 28 is preferably held to a minimum which will insure against breakage under shooting conditions and the rim 26 is preferably made wide enough to insure a definite framing of the apertures when the sight is close to the archer's eye.

The hub portion 24 is longitudinally split as indicated at 30 and the rim is cut through as indicated at 32 to permit convenient assembly on a bow string. The sight 22 is preferably constructed as a molding of a suitable light weight synthetic thermoplastic material having sufficient elasticity or memory so that the cut 32 in the rim remains normally closed. After the sight is mounted on the bow string and suitably positioned thereon, a pair of C-form clamping bands 34 are assembled on the hub 24 above and below the rim 26 and closed around the hub sufficiently tight so that the hub frictionally grips the bow string to remain in position under shooting conditions. The C-form bands are preferably constructed of metal of such thickness and ductility that they are easily deformed.

Other constructions of the described peep sight within the spirit of this invention will occur to those skilled in this art. For example, a disc having a central hollow hub for receiving a bow string may be provided with sighting apertures and thin connecting webs instead of spokes.

The foregoing description of a preferred form of the invention is intended to be illustrative, not limiting, the scope of the invention being set forth in the appended claims.

We claim:

1. A peep sight for mounting on the bow string of an archery bow comprising a disc having a central, elongated, hollow hub portion extending perpendicularly from the plane of said disc for receiving a bow string, a continuous rim portion, and a plurality of angularly spaced sighting apertures therein and extending from said rim portion to said central hub portion.

2. A peep sight for mounting on the bow string of a bow comprising a disc having a central, elongated, hollow hub portion extending perpendicularly from the plane of said disc for receiving a bow string, a continuous rim portion, and a plurality of angularly spaced sighting apertures in said disc extending from said rim portion to said central hub portion, said rim portion being slit and said hub portion being longitudinally slit to permit radial insertion of a bow string into said hollow hub portion whereby said sight may be mounted on a bow string when it is in a taut, bow bracing position, said peep sight being constructed of a resilient material, and means for clamping said hollow hub portion around a bow string.

3. The peep sight claimed in claim 2 in which said means for clamping said hollow hub portion around a bow string comprises a deformable C-shaped metal band.

4. A peep sight for mounting on the bow string of a bow and having the general form of a wheel and comprising a circular rim, a central, elongated, hollow hub extending perpendicularly from the plane of said rim for receiving the bow string, and a plurality of annularly spaced sighting apertures therein between said rim and said hub, and a plurality of radially extending and angularly spaced spokes connecting said hub to said rim and dividing space therein into a plurality of sighting apertures, said hollow hub being longitudinally slit and said rim being slit for permitting radial insertion of a bow string into said hollow hub, and means for clamping said longitudinally slit hub around a bow string.

5. The peep sight claimed in claim 4 in which said spokes are small in cross-section so as not to obstruct vision and said rim being of such width as to be clearly visible to an archer's aiming eye both when said sight is mounted on a braced bow string and when it is tilted when the bow string is drawn.

6. The peep sight claimed in claim 4 in which said elongated, hollow hub extends perpendicularly from both sides of the plane of said rim.

* * * * *